US009053674B2

(12) United States Patent
Chen et al.

(10) Patent No.: US 9,053,674 B2
(45) Date of Patent: Jun. 9, 2015

(54) OVERDRIVE APPARATUS FOR DYNAMICALLY LOADING REQUIRED OVERDRIVE LOOK-UP TABLES INTO TABLE STORAGE DEVICES AND RELATED OVERDRIVE METHOD

(75) Inventors: Chiuan-Shian Chen, Tainan (TW); Wei-Hsien Lin, Hsinchu (TW)

(73) Assignee: MEDIATEK INC., Science-Based Industrial Park, Hsin-Chu (TW)

( * ) Notice: Subject to any disclaimer, the term of this patent is extended or adjusted under 35 U.S.C. 154(b) by 181 days.

(21) Appl. No.: 13/342,192

(22) Filed: Jan. 2, 2012

(65) Prior Publication Data

US 2013/0169613 A1 Jul. 4, 2013

(51) Int. Cl.
*G09G 3/36* (2006.01)

(52) U.S. Cl.
CPC ..... *G09G 3/3611* (2013.01); *G09G 2320/0233* (2013.01); *G09G 2320/0252* (2013.01); *G09G 2320/0285* (2013.01); *G09G 2320/041* (2013.01); *G09G 2340/16* (2013.01)

(58) Field of Classification Search
CPC combination set(s) only.
See application file for complete search history.

(56) References Cited

U.S. PATENT DOCUMENTS

| | | | | |
|---|---|---|---|---|
| 7,375,723 | B2 * | 5/2008 | Cheon et al. | 345/204 |
| 7,804,505 | B2 * | 9/2010 | Watanabe et al. | 345/547 |
| 2005/0099549 | A1 * | 5/2005 | Chen et al. | 349/41 |
| 2007/0019003 | A1 * | 1/2007 | Imai et al. | 345/629 |
| 2007/0024563 | A1 | 2/2007 | Oura | |
| 2007/0222726 | A1 * | 9/2007 | Chen et al. | 345/87 |
| 2008/0212875 | A1 * | 9/2008 | Lee et al. | 382/166 |
| 2008/0224981 | A1 * | 9/2008 | Shen et al. | 345/98 |
| 2009/0009461 | A1 * | 1/2009 | Chia et al. | 345/99 |
| 2009/0309903 | A1 | 12/2009 | Park | |
| 2010/0079429 | A1 * | 4/2010 | Hirose et al. | 345/209 |
| 2010/0302287 | A1 * | 12/2010 | Katayama et al. | 345/690 |
| 2011/0063337 | A1 * | 3/2011 | Lin et al. | 345/690 |
| 2011/0069096 | A1 * | 3/2011 | Li et al. | 345/690 |
| 2011/0175954 | A1 * | 7/2011 | Lee et al. | 345/694 |
| 2011/0221717 | A1 * | 9/2011 | Liu et al. | 345/204 |

FOREIGN PATENT DOCUMENTS

| | | | |
|---|---|---|---|
| CN | 101645256 | A | 2/2010 |
| CN | 101667401 | A | 3/2010 |

* cited by examiner

*Primary Examiner* — Kumar Patel
*Assistant Examiner* — Amy C Onyekaba
(74) *Attorney, Agent, or Firm* — Winston Hsu; Scott Margo

(57) ABSTRACT

An overdrive apparatus includes a data storage device, a plurality of table storage devices, and a table access interface. The data storage device is arranged for storing a plurality of overdrive look-up tables corresponding to a plurality of first display regions included in a display area of a display apparatus. The table storage devices are arranged for storing a plurality of selected overdrive look-up tables, respectively. The table access interface is coupled between the data storage device and the table storage devices, and arranged for loading the selected overdrive look-up tables selected from the overdrive look-up tables stored in the data storage device into the table storage devices. The number of the table storage devices is smaller than the number of the display regions.

20 Claims, 12 Drawing Sheets

OVERDRIVE APPARATUS FOR DYNAMICALLY LOADING REQUIRED OVERDRIVE LOOK-UP TABLES INTO TABLE STORAGE DEVICES AND RELATED OVERDRIVE METHOD

BACKGROUND

The disclosed embodiments of the present invention relate to an overdrive technique of a display panel, and more particularly, to an overdrive apparatus for dynamically loading required overdrive look-up tables into table storage devices and related overdrive method thereof.

In recent years, liquid crystal display (LCD) apparatuses have been utilized in various applications such as televisions and personal computers. However, an LCD panel generally has low response speed due to the inherent characteristics of liquid crystal cells. Therefore, overdrive methods have been applied to the LCD panel, in order to increase the response speed. Overdrive processing is a processing method for setting a driving voltage applied to a liquid crystal cell (i.e., a pixel) to be higher than an original one if a direction of pixel data change from a previous frame to a current frame is positive, but setting the driving voltage to be lower than the original one if the direction of pixel data change from the previous frame to the current frame is negative. Specifically, this overdrive method can improve display quality of moving images shown on the LCD panel.

In general, a single overdrive look-up table is employed by the overdrive operation for determining the overdrive values of all pixels in a display area of the LCD panel. More specifically, one table storage device, such as a statistic random access memory (SRAM) device, is used for buffering the overdrive look-up table. However, different regions in the display area of the LCD panel may have different temperatures or different LC cell rotation requirements. In another conventional design, the display area of the display panel is divided into N regions each requiring an overdrive look-up table, and N table storage devices (e.g., N SRAM devices) are needed to buffer these overdrive look-up tables used by the overdrive operation. In other words, overall size of table storage devices employed in the conventional design is quite large, thus increasing the chip size and production cost inevitably.

SUMMARY

In accordance with exemplary embodiments of the present invention, an overdrive apparatus for dynamically loading required overdrive look-up tables into table storage devices and related overdrive method thereof are proposed to solve the above-mentioned problem.

According to a first aspect of the present invention, an exemplary overdrive apparatus is disclosed. The exemplary overdrive apparatus includes a data storage device, a plurality of table storage devices, and a table access interface. The data storage device is arranged for storing a plurality of overdrive look-up tables corresponding to a plurality of first display regions included in a display area of a display apparatus. The table storage devices are arranged for storing a plurality of selected overdrive look-up tables, respectively. The table access interface is coupled between the data storage device and the table storage devices, and arranged for loading the selected overdrive look-up tables stored in the data storage device into the table storage devices, wherein a number of the table storage devices is smaller than a number of the display regions.

According to a second aspect of the present invention, an exemplary overdrive apparatus is disclosed. The exemplary overdrive apparatus includes a data storage device, a plurality of table storage devices, and a table access interface. The data storage device is arranged for storing a plurality of overdrive look-up tables corresponding to a plurality of first display regions included in a display area of a display apparatus, wherein the display area of the display apparatus further includes a plurality of second display regions. The table storage devices are arranged for storing a plurality of selected overdrive look-up tables, respectively. The table access interface is coupled between the data storage device and the table storage devices, and arranged for loading the selected overdrive look-up tables selected from the overdrive look-up tables stored in the data storage device into the table storage devices;

wherein the table access interface loads a first overdrive look-up table of the selected overdrive look-up tables into a first table storage device of the table storage devices while a plurality of second overdrive look-up tables of the selected overdrive look-up tables stored in a plurality of second table storage devices of the table storage devices are being used for driving a second display region.

According to a third aspect of the present invention, an exemplary overdrive method is disclosed. The exemplary overdrive method includes: storing a plurality of overdrive look-up tables corresponding to a plurality of first display regions included in a display area of a display apparatus; and loading a plurality of selected overdrive look-up tables selected from the overdrive look-up tables into a plurality of table storage devices, respectively, wherein a number of the table storage devices is smaller than a number of the display regions.

According to a third aspect of the present invention, an exemplary overdrive method is disclosed. The exemplary method includes: storing a plurality of overdrive look-up tables corresponding to a plurality of first display regions included in a display area of a display apparatus, wherein the display area of the display apparatus further includes a plurality of second display regions; and loading a first overdrive look-up table of a plurality of selected overdrive look-up tables selected from the overdrive look-up tables into a first table storage device of a plurality of table storage devices while a plurality of second overdrive look-up tables of the selected overdrive look-up tables stored in a plurality of second table storage devices of the table storage devices are being used for driving a second display region.

These and other objectives of the present invention will no doubt become obvious to those of ordinary skill in the art after reading the following detailed description of the preferred embodiment that is illustrated in the various figures and drawings.

DETAILED DESCRIPTION

Certain terms are used throughout the description and following claims to refer to particular components. As one skilled in the art will appreciate, manufacturers may refer to a component by different names. This document does not intend to distinguish between components that differ in name but not function. In the following description and in the claims, the terms "include" and "comprise" are used in an open-ended fashion, and thus should be interpreted to mean "include, but not limited to . . . ". Also, the term "couple" is intended to mean either an indirect or direct electrical connection. Accordingly, if one device is electrically connected to another device, that connection may be through a direct electrical connection, or through an indirect electrical connection via other devices and connections.

The main concept of the present invention is to dynamically load required overdrive look-up tables into table storage devices. As the required overdrive look-up tables are loaded on demand, the overdrive apparatus therefore does not need to load all of the overdrive look-up tables initially. In this way, the overall size of the table storage devices (e.g., SRAM devices) is reduced to relax the hardware requirement. Further details are described as below.

Figure 1:
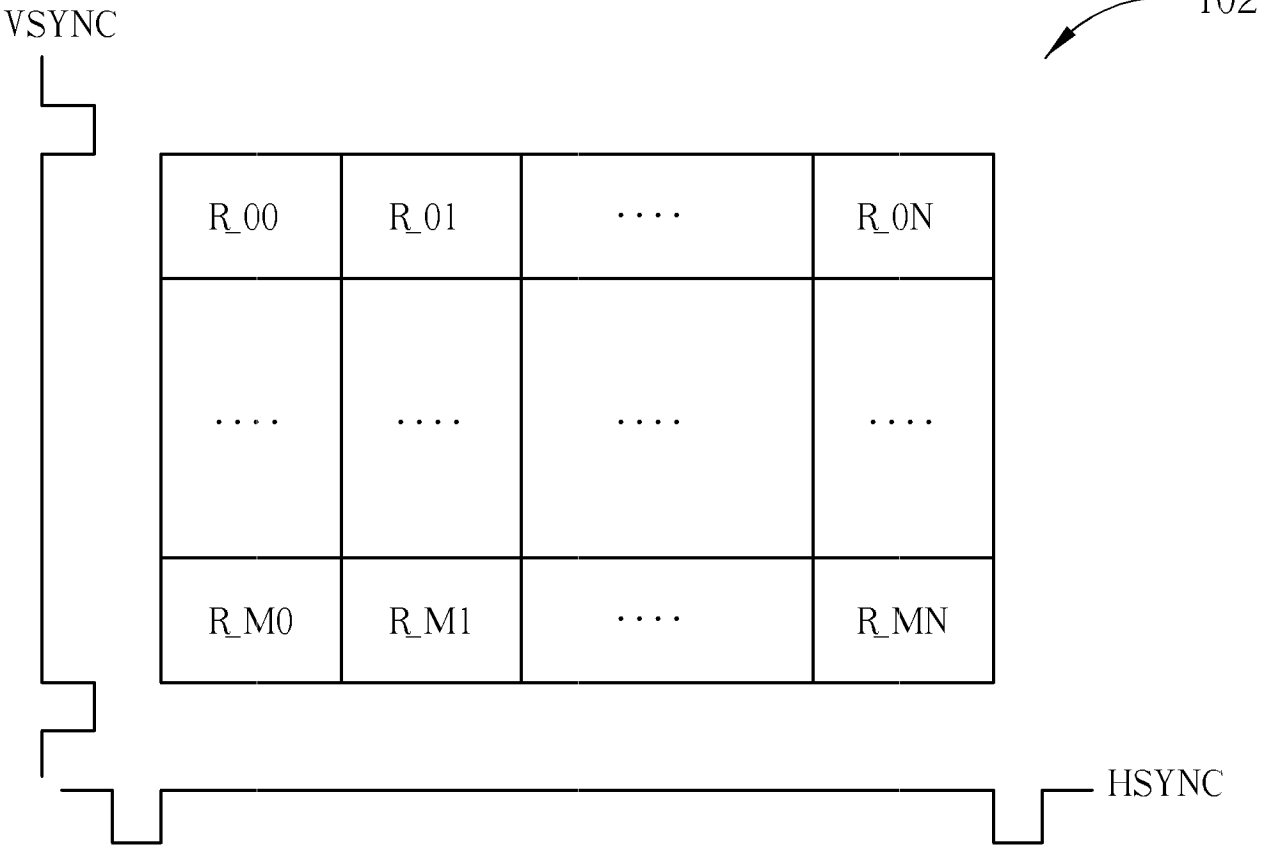
FIG. 1 is a diagram illustrating a first exemplary partition design of a display area of a display apparatus.
Figure 2:
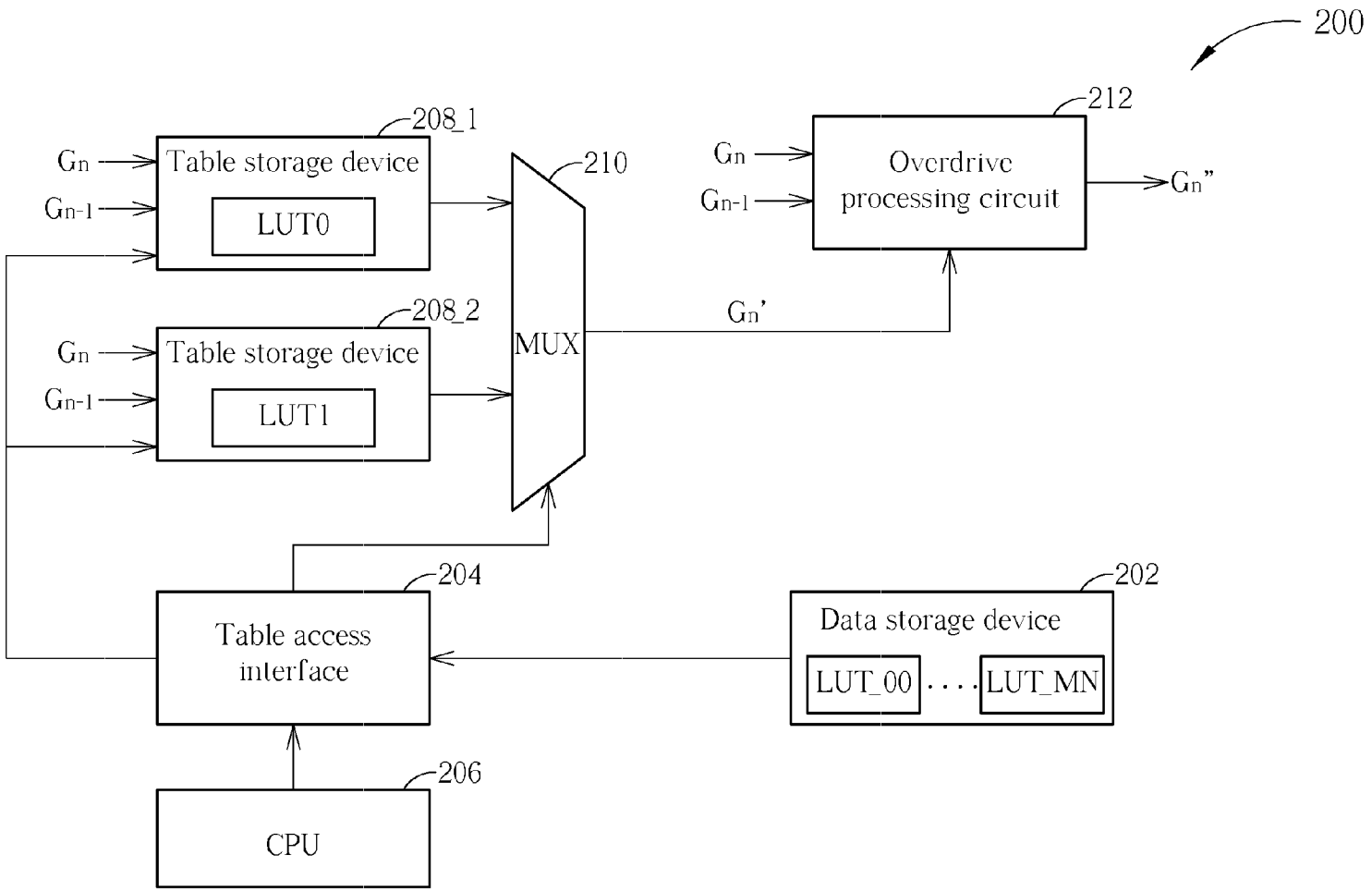
FIG. 2 is a diagram illustrating an overdrive apparatus according to a first exemplary embodiment of the present invention.

Please refer to FIG. 1 in conjunction with FIG. 2. FIG. 1 is a diagram illustrating a first exemplary partition design of a display area of a display apparatus. FIG. 2 is a diagram illustrating an overdrive apparatus according to a first exemplary embodiment of the present invention. As shown in FIG. 1, a display area 102 of a display apparatus (e.g., an LCD apparatus) is divided into a plurality of regions (e.g., R_00, R_01, R_0N, R_M0, R_M1, and R_MN). More specifically, the display area 102 has (N+1) vertical sections horizontally, and has (M+1) horizontal sections vertically. It should be noted, based on the actual design requirement/consideration, each of the horizontal sections may include one or more pixel rows, and each of the vertical sections may include one or more pixel columns. For example, in one exemplary design, M and N are both positive integers, resulting in a panel partition design as shown in FIG. 1; in another exemplary design, M=0 and N is any positive integer, resulting in a panel partition design having vertical sections only; and in yet another exemplary design, N=0 and M is any positive integer, resulting in a panel partition design having horizontal sections only. No matter which panel partition design is employed for defining the display regions in the display area 102, the spirit of the present in obeyed as long as the required overdrive look-up tables are loaded dynamically.

As each of the (M+1)×(N+1) display regions requires one overdrive look-up table, (M+1)×(N+1) overdrive look-up tables are needed by the overdrive operation performed upon pixels of the display area 102. A dynamic loading scheme is employed by the overdrive apparatus 200 shown in FIG. 2 to achieve the objective of using fewer table storage devices for cost reduction. As shown in FIG. 2, the exemplary overdrive apparatus 200 includes, but is not limited to, a data storage device 202, a table access interface 204, a central processing unit (CPU) 206, a plurality of table storage devices 208_1, 208_2, a multiplexer (MUX) 210, and an overdrive processing circuit 212. By way of example, but not limitation, the data storage device 202 may be implemented using a dynamic random access memory (DRAM) device, and the table storage devices 208_1 and 208_2 may be implemented using SRAM devices. The data storage device 202 is arranged for storing a plurality of pre-defined overdrive look-up tables LUT_00-LUT_MN corresponding to the display regions R_00-R_MN, respectively. For example, the overdrive look-up tables LUT_00-LUT_MN may be recorded in a non-volatile storage device such as a flash memory (not shown), and loaded into the data storage device 202 under control of the CPU 206 when an application using the overdrive apparatus 200 is powered on. In this exemplary embodiment, the overdrive apparatus 200 has two table storage devices 208_1 and 208_2 arranged for storing a plurality of selected overdrive look-up tables LUT0 and LUT1, respectively. The table access interface 204 is coupled between the data storage device 202 and the table storage devices 208_1 and 208_2, and is controlled by the CPU 206 for loading the selected overdrive look-up tables LUT0 and LUT1 selected from the overdrive look-up tables LUT_00-LUT_MN stored in the data storage device 202 into the table storage devices 208_1 and 208_2.

As can be readily seen from FIG. 2, the number of the table storage devices 208_1 and 208_2 is smaller than the number of the display regions R_00-R_MN (i.e., 2<(N+1)×(M+1)). Therefore, the selected overdrive look-up tables LUT0 and LUT1 would be dynamically updated. In general, pixels of the display panel 102 are driven in a raster scan manner. Considering an exemplary case where each of the (M+1) horizontal sections includes two rows. Thus, the overdrive look-up tables R_00-R_0N are sequentially used by the overdrive operation for driving pixels located at the first row, and then the overdrive look-up tables R_00-R_0N are sequentially used again by the overdrive operation for driving pixels located at the second row. Therefore, in the beginning, the overdrive look-up table corresponding to the display region R_00 is selected and loaded into the table storage device 208_1, and the multiplexer 210 is notified by the table access interface 204 to therefore couple the table storage device 208_1 to the overdrive processing circuit 212. Each pixel in the display region R_00 that is co-located in a current frame and a previous frame has a pixel value $G_n$ in the current frame and a pixel value $G_{n-1}$ in the previous frame. The pixel values $G_n$ and $G_{n-1}$ would act as table index values used to search for data recorded in the overdrive look-up table. Therefore, an overdrive calculation value $G_n'$ is derived from the overdrive look-up table LUT0 and transmitted to the following overdrive processing circuit 212 via the multiplexer 210. Next, the overdrive processing circuit 212 converts the received overdrive calculation value $G_n'$ into the target overdrive value $G_n''$.

For example, the overdrive processing circuit 212 may determine the target overdrive value $G_n''$ by performing interpolation according to the overdrive calculation value $G_n'$.

As can be seen from FIG. 1, the overdrive look-up table corresponding to the next display region R_01 will be needed by the overdrive operation after pixels located at one specific row within the display region R_00 are successfully driven. In this exemplary embodiment, the table access interface 204 loads an overdrive look-up table corresponding to the display region R_01 (i.e., the selected overdrive look-up table LUT1) into the table storage device 208_2 while the overdrive look-up table corresponding to the display region R_00 (i.e., the selected overdrive look-up table LUT0) that is stored in the table storage device 208_1 is being used for driving pixels of the corresponding display region R_00. After pixels located at the specific row within the display region R_00 are successfully driven, the multiplexer 210 would be switched to couple the table storage device 208_2 to the overdrive processing circuit 212. Similarly, each pixel in the display region R_01 that is co-located in the current frame and the previous frame has a pixel value $G_n$ in the current frame and a pixel value $G_{n-1}$ in the previous frame. As the pixel values $G_n$ and $G_{n-1}$ act as table index values, an overdrive calculation value $G_n'$ is derived from the overdrive look-up table LUT1 and transmitted to the overdrive processing circuit 212 via the multiplexer 210. Next, the overdrive processing circuit 212 converts the overdrive calculation value $G_n'$ into the target overdrive value $G_n''$.

As can be seen from FIG. 1, the overdrive look-up table corresponding to the next display region will be needed by the overdrive operation after pixels located at the specific row within the display region R_01 are successfully driven. Similarly, the table access interface 204 loads an overdrive look-up table corresponding to the next display region into the table storage device 208_1 to update the selected overdrive look-up table LUTO while the overdrive look-up table corresponding to the display region R_01 (i.e., the selected overdrive look-up table LUT1) that is stored in the table storage device 208_2 is being used for driving pixels of the corresponding display region R_01. As the following dynamic overdrive look-up table loading operation performed during the raster scan of the display area 102 may be easily deduced by analogy, further description is omitted here for brevity.

To put it simply, all of the overdrive look-up tables LUT_00-LUT_MN corresponding to the display regions R_00-R_MN are stored in the data storage device 202, and the CPU 206 can easily control the table access interface 204 to read any desired overdrive look-up table from the data storage device 202 by properly setting address of a requested overdrive look-up table and then instructing the table access interface 204 to perform the data fetch. In this way, the overdrive look-up tables buffered in the table storage devices 208_1 and 208_2 are dynamically updated and alternately used by the overdrive operation for sequentially driving pixels located in different display regions.

As mentioned above, one of the selected overdrive look-up tables LUT0 and LUT1 should be loaded/updated while the other of the selected overdrive look-up tables LUT0 and LUT1 is being used for driving a corresponding display region. Therefore, it should be guaranteed that loading/updating of one of the selected overdrive look-up tables LUT0 and LUT1 is successfully completed before the overdrive operation performed upon pixels of a specific row by referring to the other of the selected overdrive look-up tables LUT0 and LUT1 is done. When the instant bandwidth of the data storage device 202 is not large enough for satisfying the requirement of loading/updating the selected overdrive look-up tables LUT0/LUT1, a data buffering device with a higher data access speed may be employed. Please refer to FIG. 3, which is a diagram illustrating an overdrive apparatus according to a second exemplary embodiment of the present invention. The major difference between the overdrive apparatuses 200 and 300 is that the overdrive apparatus 300 further includes a data buffering device 302 coupled between the table access interface 204 and the data storage device 202. For example, the data buffering device 302 is an SRAM device, and the data storage device 202 is a DRAM device. Therefore, the data access speed of the data buffering device 302 would be higher than the data access speed of the data storage device 202, and the data buffering device 302 therefore would have a larger memory bandwidth accordingly. Specifically, the data buffering device 302 is arranged for buffering the selected overdrive look-up tables LUT0 and LUT1 pre-fetched from the data storage device 202. For example, one of the selected overdrive look-up tables LUT0 and LUT1 is pre-fetched by the data buffering device 302 and then loaded into one of the table storage device 208_1, 208_2, while the other of the selected overdrive look-up tables LUT0 and LUT1 is being used for driving a corresponding display region. To put it simply, the table access interface 204 reads the data buffering device 302 to load the required overdrive look-up tables buffered in the data buffering device 302 into the table storage devices 208_1 and 208_2. Preferably, all of the overdrive look-up tables of the display regions included in one horizontal section of the display area 102 are read from the data storage device 202 and buffered into the data buffering device 302. Hence, the number of times of accessing the data storage device 202 during the overdrive operation performed upon all pixels in the horizontal section of the display area 102 is effectively reduced if the horizontal section of the display area 102 has more than one pixel row. The overall overdrive look-up table loading/updating performance is greatly improved due to the implemented data buffering device 302.

Figure 4:
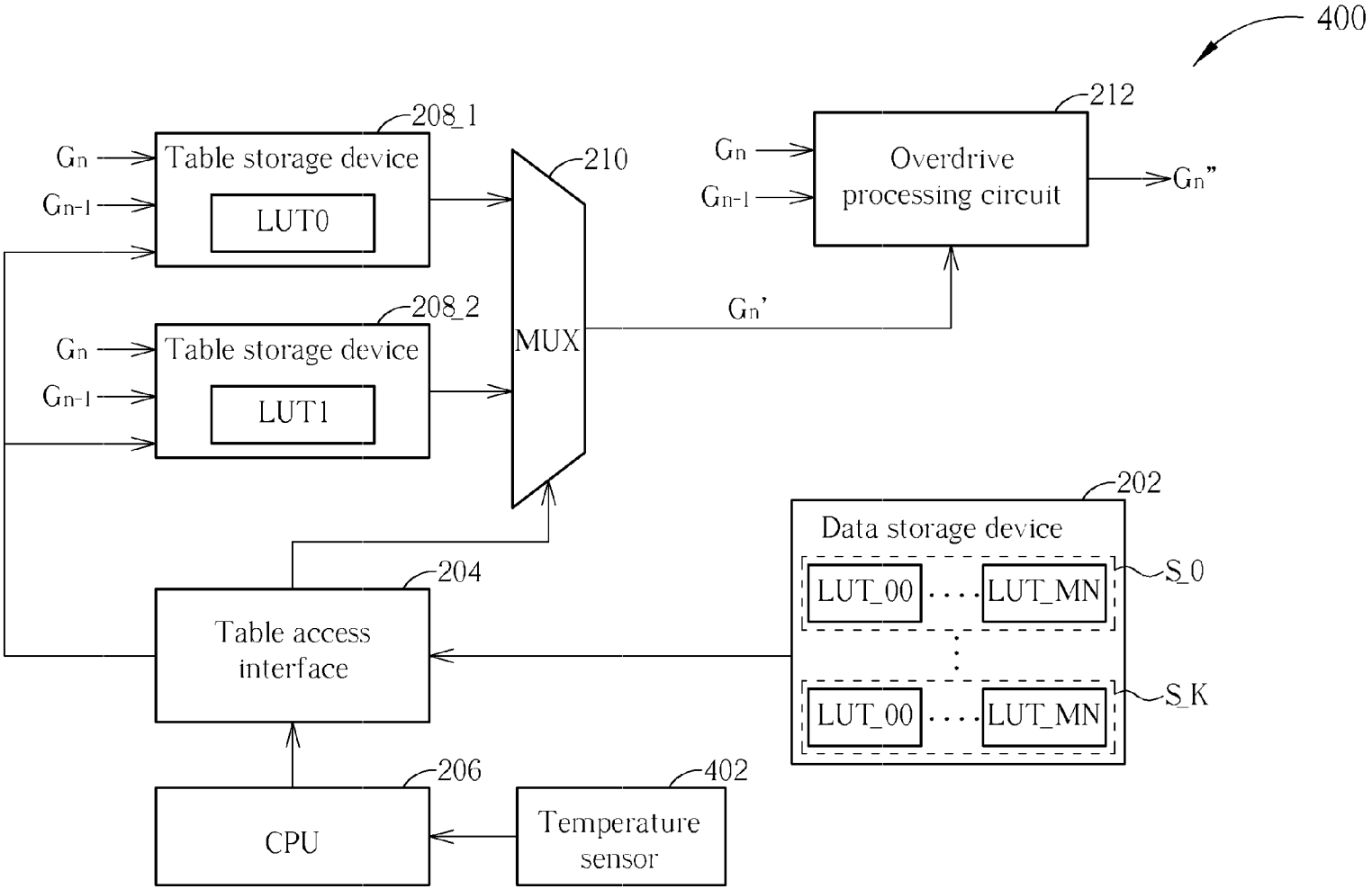
FIG. 4 is a diagram illustrating an overdrive apparatus according to a third exemplary embodiment of the present invention.

As known to those skilled in the pertinent art, the response speed of the LCD apparatus depends on the temperature. Namely, the response speed of an LC cell increases with increasing temperature, while the response speed of the LC cell decreases with decreasing temperature. To deal with the response speed change resulting from the time-variant temperature, more than one overdrive look-up table setting should be employed. Please refer to FIG. 4, which is a diagram illustrating an overdrive apparatus according to a third exemplary embodiment of the present invention. The major difference between the overdrive apparatuses 200 and 400 is that the overdrive apparatus 400 further includes a temperature sensor 402, and the data storage device 202 stores a plurality of overdrive look-up table settings S_0-S_K each having a plurality of overdrive look-up tables LUT_00-LUT_MN corresponding to the display regions R_00-R_MN shown in FIG. 1. It should be noted that the overdrive look-up table settings S_0-S_K are different from one another. For example, regarding at least one of the display regions R_00-R_MN, a corresponding overdrive look-up table included in one overdrive look-up table setting is different from a corresponding overdrive look-up table included in another overdrive look-up table setting. In this embodiment, the temperature sensor 402 is arranged for detecting a work temperature, and the CPU 206 refers to the detected work temperature to decide which one of the available overdrive look-up table settings should be used. Hence, regarding at least one of the display regions R_00-R_MN, a selected overdrive look-up table loaded by the table access interface 204 under a first work temperature detected by the temperature sensor 402 may be different from the selected overdrive look-up table loaded by the table access interface 204 under a second work temperature detected by the temperature sensor 402.

Figure 5:
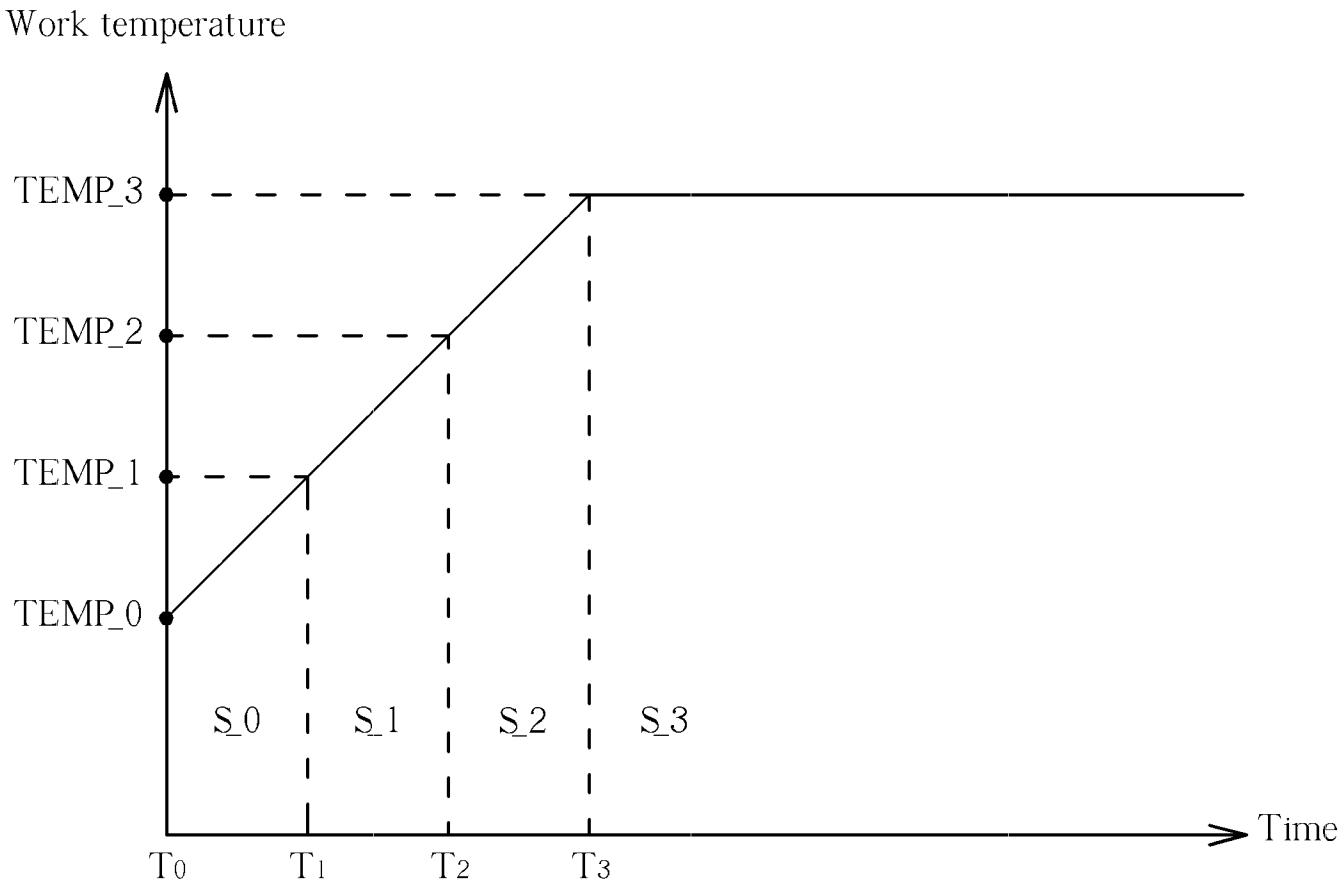
FIG. 5 is a diagram illustrating an example of switching between different overdrive look-up table settings according to the time-variant work temperature.

FIG. 5 is a diagram illustrating an example of switching between different overdrive look-up table settings according to the time-variant work temperature. At time $T_0$, the initial work temperature detected by the temperature sensor 402 is TEMP_0. Therefore, the overdrive look-up table setting S_0 is initially used. When the work temperature increases from TEMP_0 to TEMP_1, the current overdrive look-up table setting is switched from S_0 to S_1 at time $T_1$. When the work temperature keeps increasing from TEMP_1 to TEMP_2, the current overdrive look-up table setting is switched from S_1 to S_2 at time $T_2$. When the temperature finally reaches the normal work temperature TEMP_3 at time $T_3$, the current overdrive look-up table setting is switched from S_2 to S_3. As the overdrive look-up table setting is dynamically adjusted in accordance with the work temperature change, a proper overdrive look-up table setting would be selected and used by the overdrive operation to achieve the optimum overdrive performance.

Figure 3:
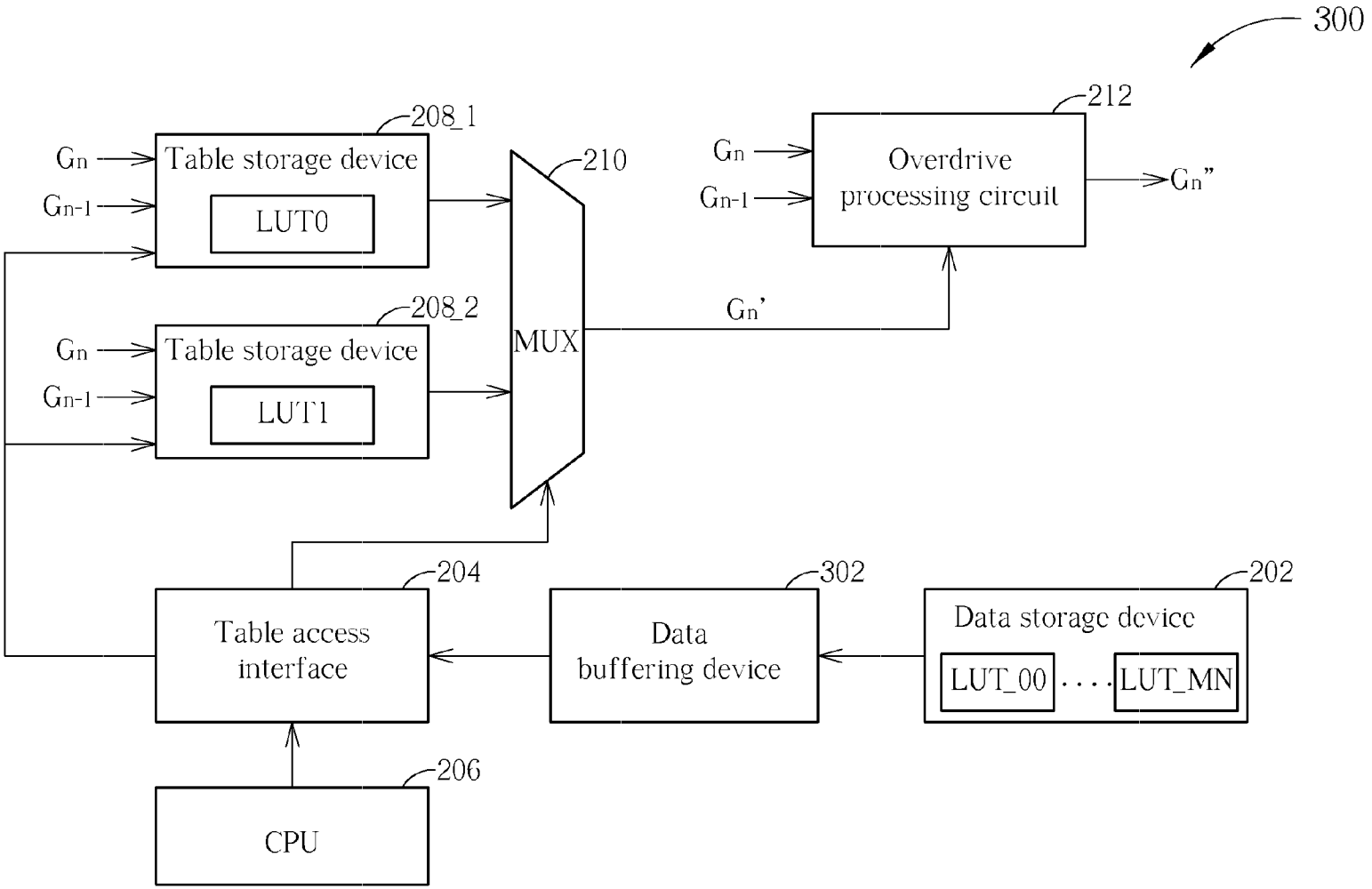
FIG. 3 is a diagram illustrating an overdrive apparatus according to a second exemplary embodiment of the present invention.
Figure 6:
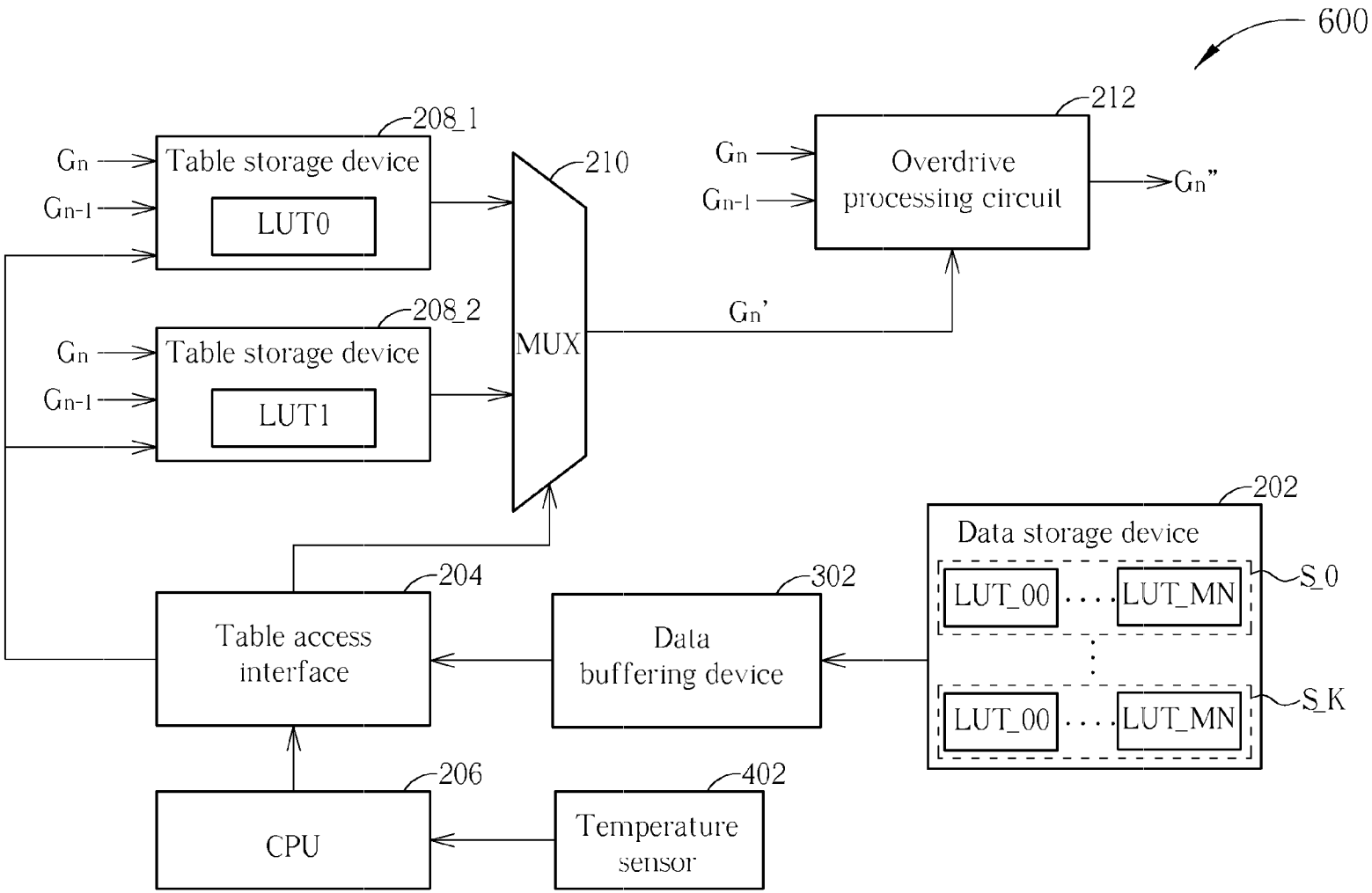
FIG. 6 is a diagram illustrating an overdrive apparatus according to a fourth exemplary embodiment of the present invention.

The same temperature-based overdrive look-up table setting switching scheme may be applied to the overdrive apparatus 300 shown in FIG. 3. Please refer to FIG. 6, which is a diagram illustrating an overdrive apparatus according to a fourth exemplary embodiment of the present invention. The major difference between the overdrive apparatuses 300 and 600 is that the overdrive apparatus 600 includes the aforementioned temperature sensor 402, and the data storage device 202 now stores a plurality of different overdrive look-up table settings S_0-S_K. As a person skilled in the art can readily understand operations of the overdrive apparatus 600 after reading above paragraphs, further description is omitted here for brevity.

Figure 7:
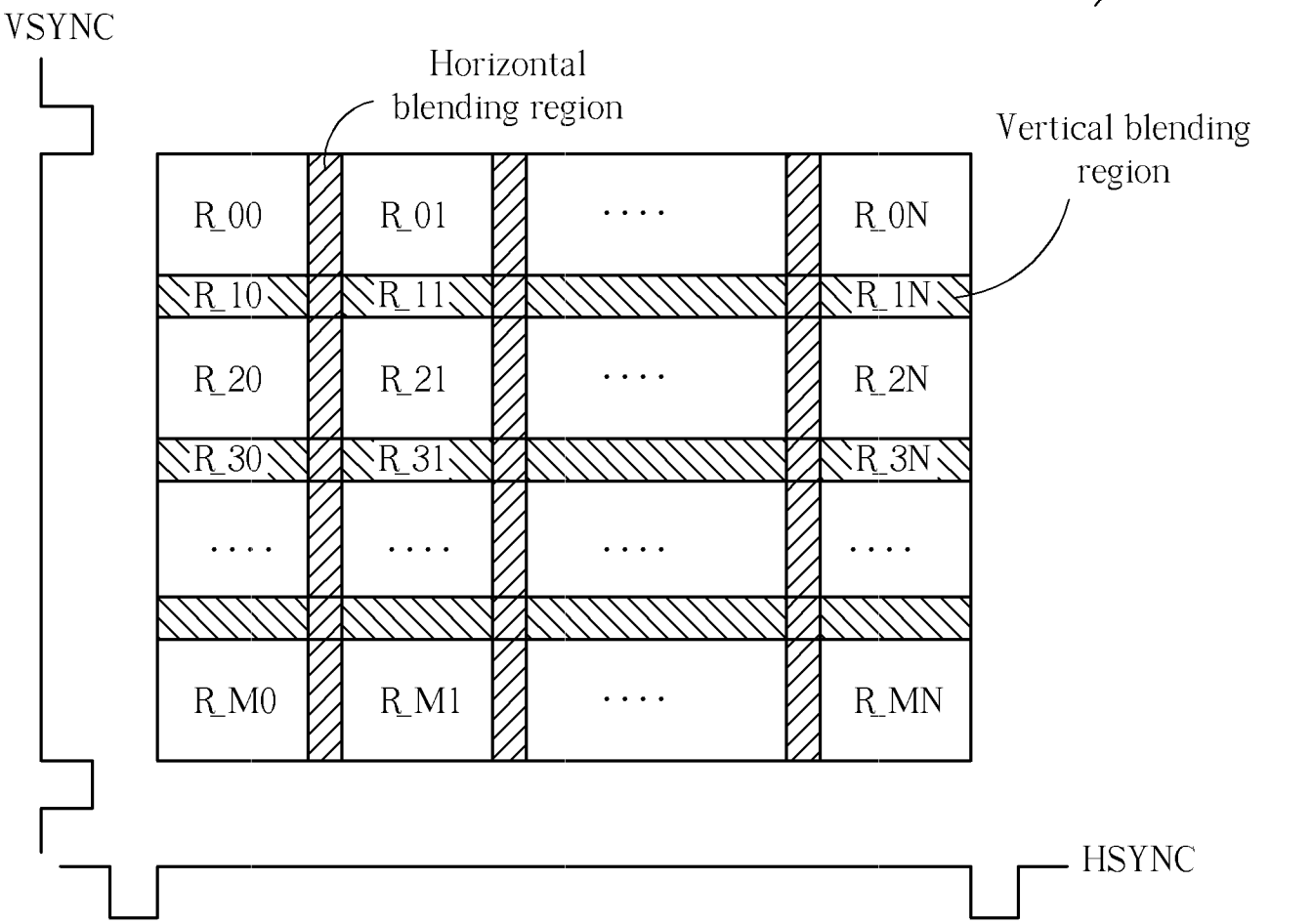
FIG. 7 is a diagram illustrating a second exemplary partition design of a display area of a display apparatus.

The present invention also proposes a horizontal and vertical blending scheme to improve the display quality of the LCD panel. Please refer to FIG. 7, which is a diagram illustrating a second exemplary partition design of a display area of a display apparatus. As shown in FIG. 7, a display area 702 of a display apparatus (e.g., an LCD apparatus) includes a plurality of display regions (e.g., R_00, R_01, R_0N, R_10, R_11, R_1N, R_20, R_21, R_2N, R_30, R_31, R_3N, R_M0, R_M1, and R_MN), wherein one part of the display regions is consisted of non-blending display regions, and other part of the regions is consisted of vertical blending regions. Besides, there is one horizontal blending region located between two horizontally adjacent non-blending display regions/vertical blending regions. Each of the non-blending display regions and vertical blending regions has a pre-defined overdrive look-up table assigned thereto, whereas the overdrive operation performed upon each horizontal blending region depends on the pre-defined overdrive look-up tables of two horizontally adjacent non-blending display regions/vertical blending regions located at opposite sides of the horizontal blending region. Suppose that the width of each horizontal blending region corresponds to P pixels at the same row, and the width of each horizontal blending region is evenly divided into N segments each have P/N pixels at the same row, where a $1^{st}$ segment is immediately adjacent to a left non-blending display region/vertical blending region, and an $N^{th}$ segment is immediately adjacent to a right non-blending display region/vertical blending region. It should be noted that P and N are positive integers, and N may be equal to or smaller than P. When a specific pixel to be processed is located in an $I^{th}$ segment of a horizontal blending region, an overdrive calculation value derived from a left non-blending display region/vertical blending region for a pixel value of the specific pixel includes R0/G0/B0, and an overdrive calculation value derived from a right non-blending display region/vertical blending region for the pixel value of the specific pixel includes R1/G1/B1, a blended overdrive calculation value $R_B/G_B/B_B$ for the pixel value of the specific pixel may be expressly as follows.

$$R_B = R0*\left(1-\frac{I}{N}\right)+R1*\frac{I}{N} \tag{1}$$

$$G_B = G0*\left(1-\frac{I}{N}\right)+G1*\frac{I}{N} \tag{2}$$

$$B_B = B0*\left(1-\frac{I}{N}\right)+B1*\frac{I}{N} \tag{3}$$

It should be noted that the overdrive look-up table of each vertical blending regions (e.g., R_10, R_11, R_1N, R_30, R_31, and R_3N) is pre-defined. For example, the content of the overdrive look-up table of the vertical blending region R_ may be set by referring to a blending result of overdrive look-up tables of the horizontally adjacent non-blending display regions R_00 and R_20. Regarding each horizontal blending region, as overdrive look-up tables of the horizontally adjacent non-blending display regions/vertical blending regions are required to be sequentially loaded into the table storage devices due to the fact that pixels of the display area 702 are driven using the raster scan manner, the overdrive operation performed upon each pixel of the horizontal blending region can be easily realized by referring to loaded overdrive look-up tables of horizontally adjacent non-blending display regions/vertical blending regions.

Figure 8:
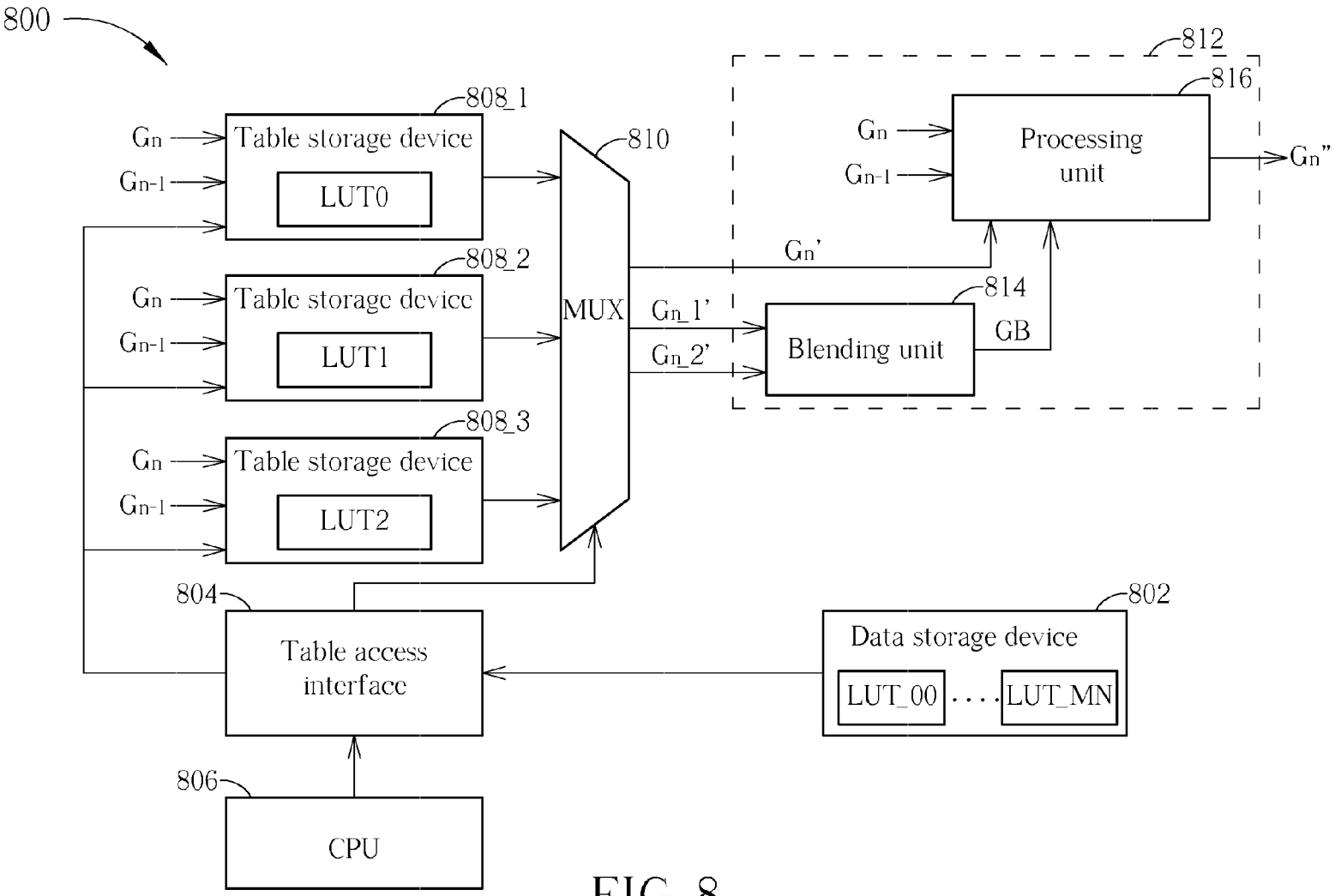
FIG. 8 is a diagram illustrating an overdrive apparatus according to a fifth exemplary embodiment of the present invention.

As a plurality of overdrive look-up tables loaded in table storage devices would be required by the blending operation, the minimum hardware requirement of implemented table storage devices is using at least three table storage devices. Please refer to FIG. 8, which is a diagram illustrating an overdrive apparatus according to a fifth exemplary embodiment of the present invention. In this exemplary embodiment, the number of the employed table storage devices is smaller than the number of display regions including vertical blending regions and non-blending display regions. Thus, a dynamic loading scheme is employed by the overdrive apparatus 800 to efficiently utilize the available table storage devices. As shown in FIG. 8, the overdrive apparatus 800 includes, but is not limited to, a data storage device 802, a table access interface 804, a CPU 806, a plurality of table storage devices 808_1, 808_2, 808_3, a MUX 810, and an overdrive processing circuit 812. In this embodiment, the overdrive processing circuit 812 includes a blending unit 814 and a processing unit 816. By way of example, but not limitation, the data storage device 802 may be implemented using a DRAM device, and the table storage devices 808_1-808_3 may be implemented using SRAM devices. As shown in the figure, only three table storage devices are implemented to meet the minimum hardware requirement. However, this is for illustrative purposes only, and is not meant to be a limitation of the present invention. For example, in an alternative design, the overdrive apparatus 800 may be modified to have more than three table storage devices, such as (M+1)×(N+1) table storage devices used for respectively loading all of the pre-defined overdrive look-up tables of the (M+1)×(N+1) display regions, including the vertical blending regions and non-blending display regions shown in FIG. 7.

The data storage device 802 is arranged for storing a plurality of pre-defined overdrive look-up tables LUT_00-LUT_MN corresponding to the display regions R_00-

R_MN, respectively. For example, the overdrive look-up tables LUT_00-LUT_MN may be recorded in a non-volatile storage device such as a flash memory (not shown), and loaded into the data storage device 802 under control of the CPU 806 when an application using the overdrive apparatus 800 is powered on. The table storage devices 808_1-808_3 are arranged for storing a plurality of selected overdrive look-up tables LUT0, LUT1, and LUT2, respectively. The table access interface 804 is coupled between the data storage device 802 and the table storage devices 808_1-808_3, and controlled by the CPU 806 for loading the selected overdrive look-up tables LUT0-LUT2 selected from the overdrive look-up tables LUT_00-LUT_MN stored in the data storage device 802 into the table storage devices 808_1-808_3.

As mentioned above, the overdrive apparatus 800 employs a dynamic loading scheme due to the number of implemented table storage devices smaller than the number of the display regions. Therefore, the selected overdrive look-up tables LUT0-LUT2 would be dynamically loaded/updated. The pixels of the display panel 702 are driven by a raster scan manner. Considering an exemplary case where each of the (N+1) non-blending display regions R_00-R_0N includes two rows. Thus, the overdrive look-up tables corresponding to non-blending display regions R_00-R_0N are sequentially used by the overdrive operation for driving pixels located at the first row, and then sequentially used again by the overdrive operation for driving pixels located at the second row. Besides, a plurality of pairs each consisted of two successive overdrive look-up tables of the overdrive look-up tables R_00-R_0N are sequentially used by the overdrive operation for driving pixels located at the first row in the horizontal blending regions, and then sequentially used by the overdrive operation again for driving pixels located at the second row in the horizontal blending regions. Therefore, in the beginning, the overdrive look-up table corresponding to the non-blending display region R_00 is selected and loaded into the table storage device 808_1, and the multiplexer 810 is notified by the table access interface 804 to therefore couple the table storage device 808_1 to the overdrive processing circuit 812. Each pixel in the non-blending display region R_00 that is co-located at a current frame and a previous frame has a pixel value $G_n$ in the current frame and a pixel value $G_{n-1}$ in the previous frame. The pixel values $G_n$ and $G_{n-1}$ act as table index values. Therefore, an overdrive calculation value $G_n'$ is derived from the overdrive look-up table LUT0 and transmitted to the processing unit 816 of the overdrive processing circuit 812 via the multiplexer 810. Next, the processing unit 816 converts the overdrive calculation value $G_n'$ into the target overdrive value $G_n''$. For example, the processing unit 816 determines the target overdrive value $G_n''$ by performing interpolation according to the overdrive calculation value $G_n'$.

As can be seen from FIG. 7, the overdrive look-up table corresponding to the non-blending display region R_01 will be needed by the horizontal blending operation after pixels located at a specific row within the non-blending display region R_00 are successfully driven. In this exemplary embodiment, the table access interface 804 loads an overdrive look-up table corresponding to the non-blending display region R_01 (i.e., the selected overdrive look-up table LUT1) into the table storage device 808_2 while the overdrive look-up table corresponding to the non-blending display region R_00 (i.e., the selected overdrive look-up table LUT0) that is stored in the table storage device 808_1 is being used for driving pixels of a corresponding non-blending display region R_00. After pixels located at the specific row within the non-blending display region R_00 are successfully driven, the multiplexer 810 couples both of the table storage devices 808_1 and 808_2 to the blending unit 814 of the overdrive processing circuit 812. Each pixel in the horizontal blending region between the non-blending display regions R_00 and R_01 is co-located in a current frame and a previous frame, and has a pixel value $G_n$ in the current frame and a pixel value $G_{n-1}$ in the previous frame. As the pixel values $G_n$ and $G_{n-1}$ act as table index values, one overdrive calculation value $G_n$_1' is derived from one of the overdrive look-up tables LUT0 and LUT1 and transmitted to the blending unit 814 via the multiplexer 810; similarly, another overdrive calculation value $G_n$_2' is derived from the other of the overdrive look-up tables LUT0 and LUT1 and transmitted to the blending unit 814 via the multiplexer 810. Next, the blending unit 814 is operative to generate a blended overdrive calculation value GB by blending the overdrive calculation values $G_n$_1' and $G_n$_2', and the processing unit 812 is operative to convert the blended overdrive calculation value GB into the target overdrive output value $G_n'$. For example, the aforementioned equations (1), (2) and (3) may be used by the blending unit 814.

As can be seen from FIG. 7, the overdrive look-up table corresponding to a non-blending display region next to the non-blending display region R_01 will be needed by the next horizontal blending operation after pixels located at the specific row within the non-blending display region R_01 are successfully driven. In this exemplary embodiment, the table access interface 804 loads an overdrive look-up table corresponding to the non-blending display region next to the non-blending display region R_01 (i.e., the selected overdrive look-up table LUT2) into the table storage device 808_3 while at least one of the overdrive look-up tables corresponding to the display regions R_00 and R_01 (i.e., the selected overdrive look-up tables LUT0 and LUT1) that is stored in the table storage devices 808_1 and 808_2 is being used for driving pixels. As the following dynamic overdrive look-up table loading operation performed during the raster scan of the display area 702 may be easily deduced by analogy, further description is omitted here for brevity.

To put it simply, all of the overdrive look-up tables LUT_00-LUT_MN corresponding to the display regions R_00-R_MN are stored in the data storage device 802, and the CPU 806 can easily control the table access interface 804 to read any desired overdrive look-up table from the data storage device 802 by properly setting address of a requested overdrive look-up table and then instructing the table access interface 804 to perform the data fetch. In this way, the overdrive look-up tables buffered in the table storage devices 808_1-808_3 are dynamically loaded/updated and used by the overdrive operation with/without horizontal blending.

Figure 9:
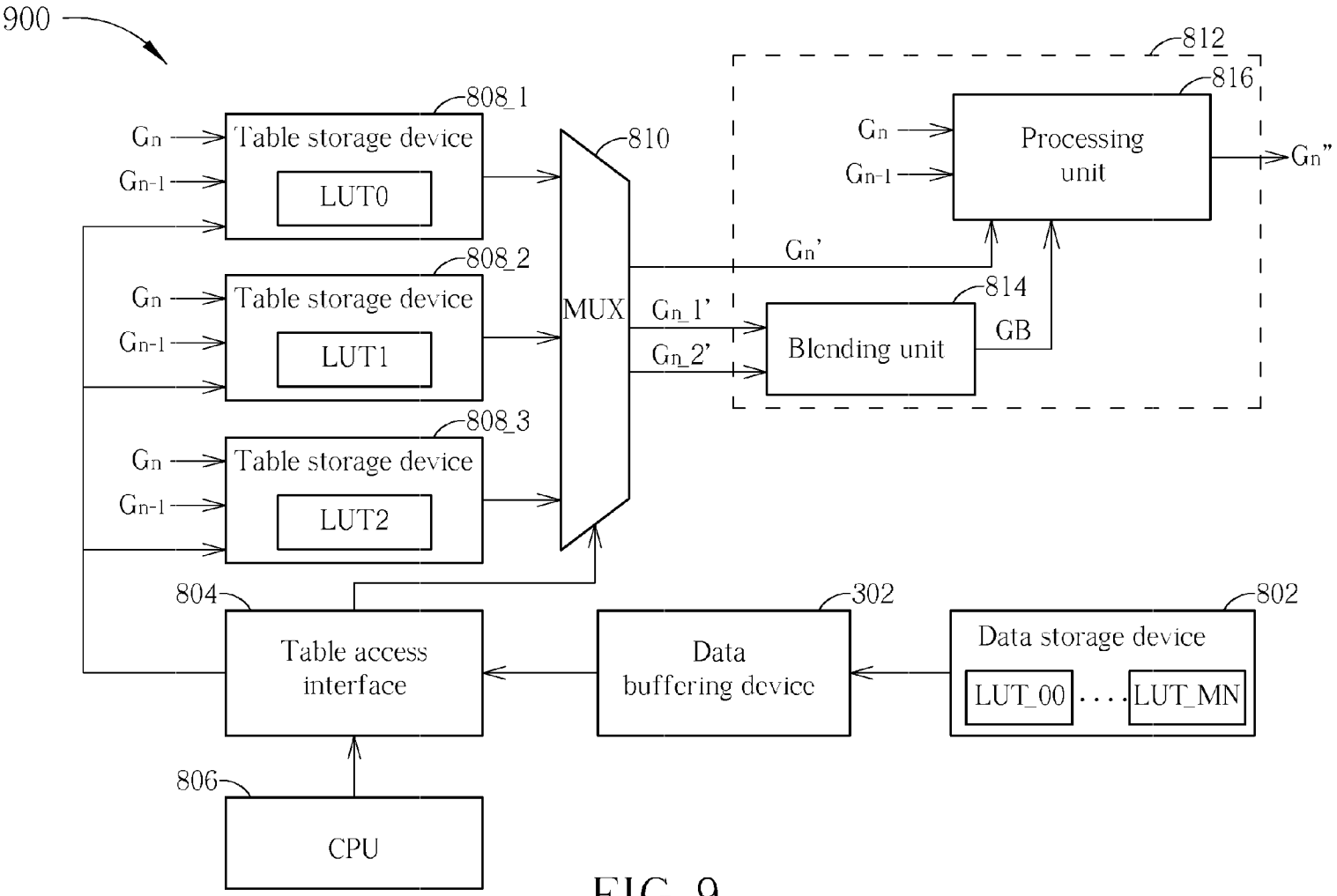
FIG. 9 is a diagram illustrating an overdrive apparatus according to a sixth exemplary embodiment of the present invention.
Figure 10:
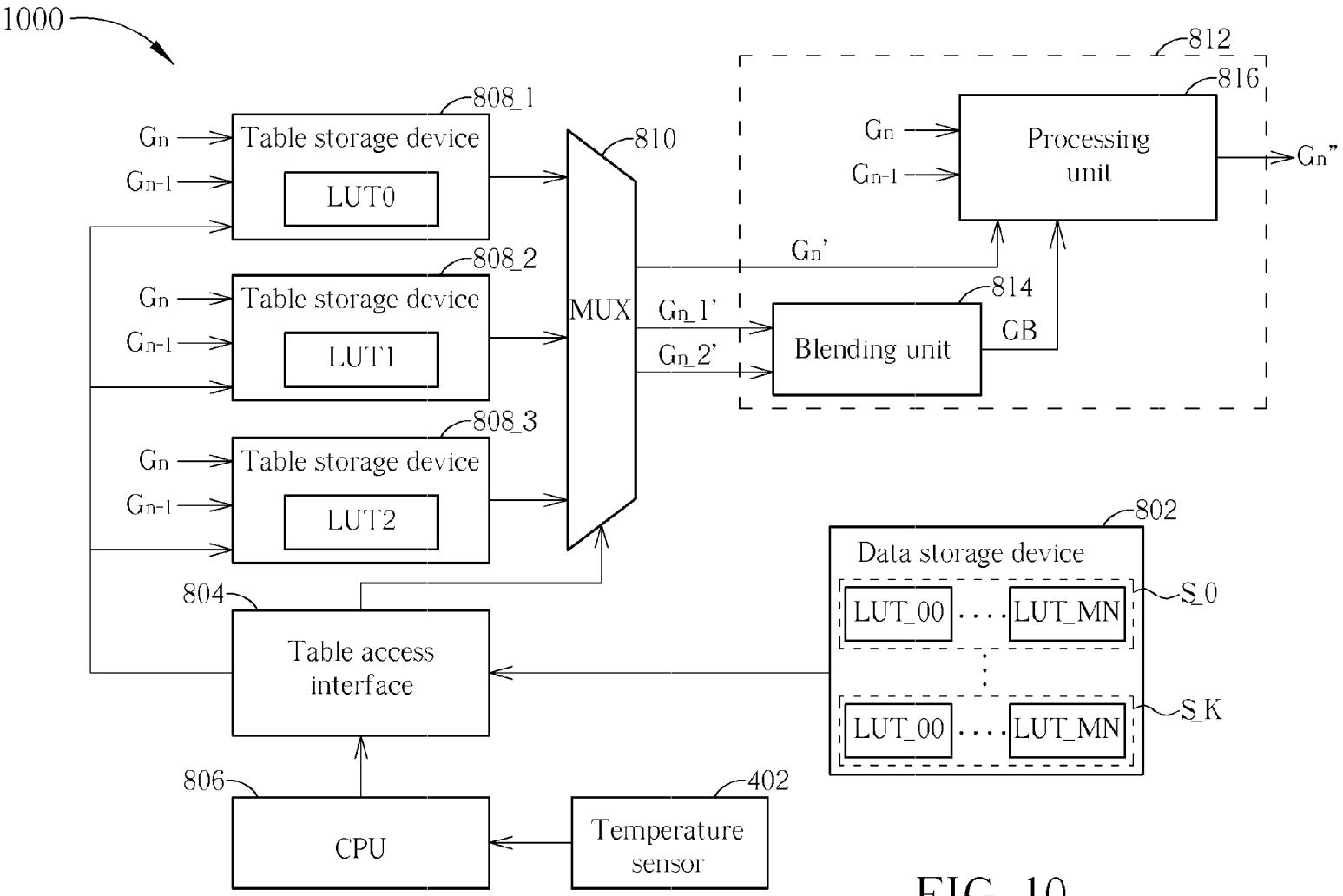
FIG. 10 is a diagram illustrating an overdrive apparatus according to a seventh exemplary embodiment of the present invention.
Figure 11:
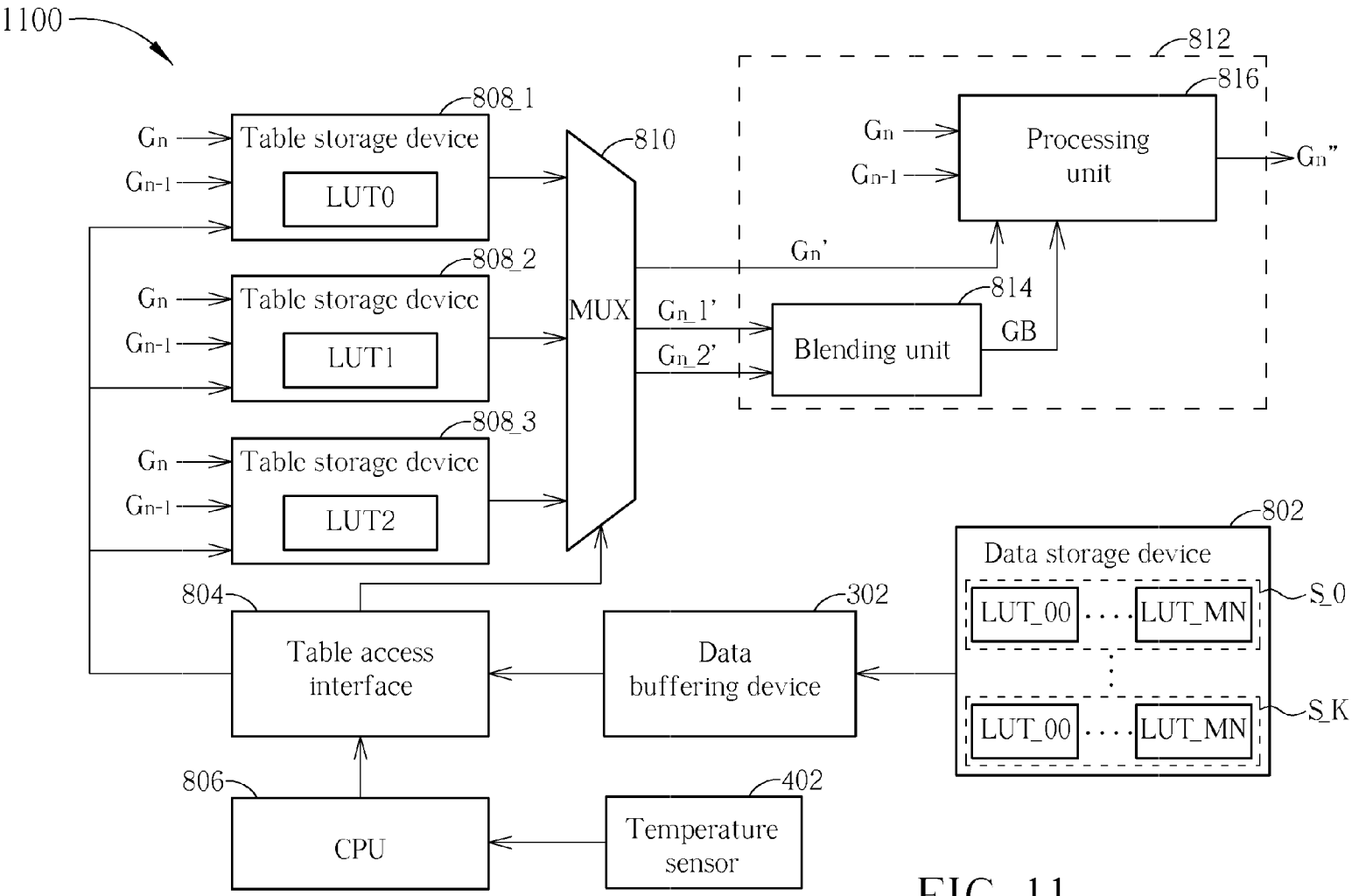
FIG. 11 is a diagram illustrating an overdrive apparatus according to an eighth exemplary embodiment of the present invention.

The aforementioned data buffering device 302 and/or temperature sensor 402 may also be applied to the overdrive apparatus 800 shown in FIG. 8. FIG. 9 is a diagram illustrating an overdrive apparatus according to a sixth exemplary embodiment of the present invention. FIG. 10 is a diagram illustrating an overdrive apparatus according to a seventh exemplary embodiment of the present invention. FIG. 11 is a diagram illustrating an overdrive apparatus according to an eighth exemplary embodiment of the present invention. As a person skilled in the art can readily understand operations of these exemplary overdrive apparatuses 900, 1000, and 1100 after reading above paragraphs directed to the embodiments shown in FIG. 3, FIG. 4, and FIG. 6, further description is omitted here for brevity.

Figure 12:
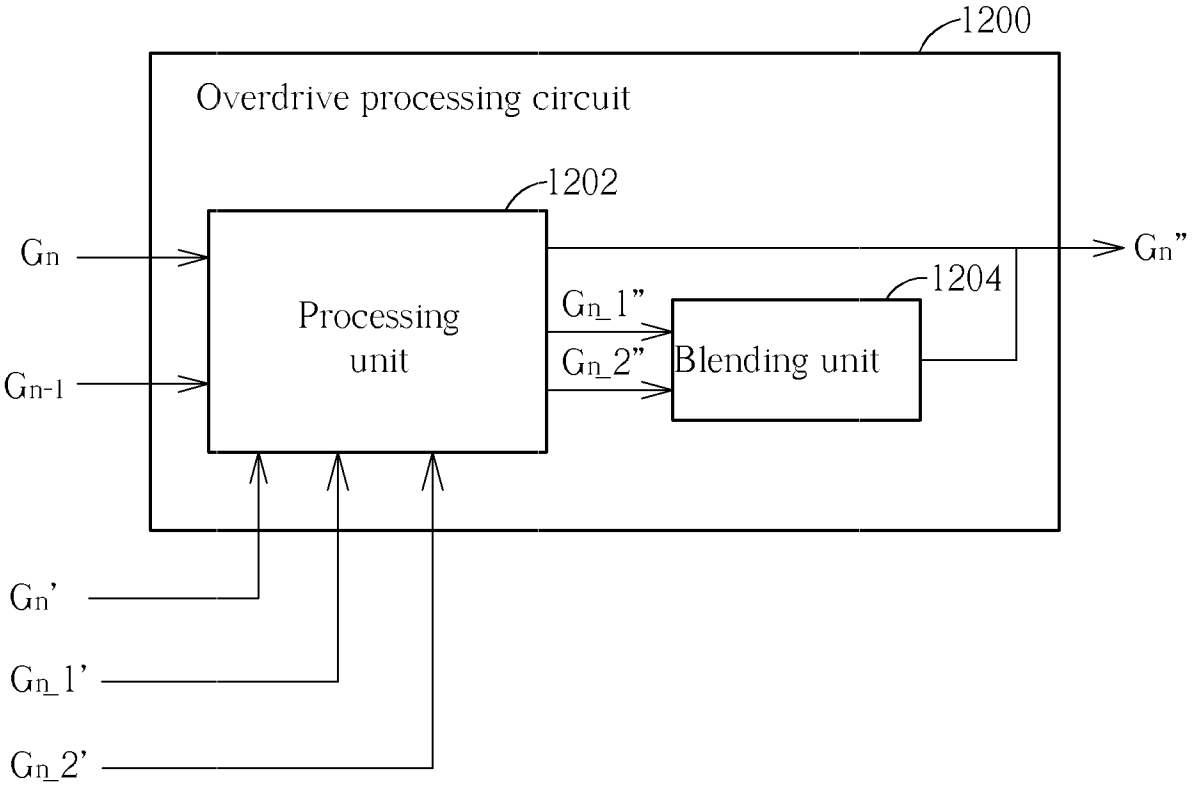
FIG. 12 is a diagram illustrating an alternative design of an overdrive processing circuit according to the present invention.

Regarding the overdrive processing circuit 812, the blending unit 814 generates a blended overdrive calculation value GB, and then the following processing unit 816 converts the blended overdrive calculation value GB into the target overdrive output value $G_n''$. However, this is for illustrative purposes only, and is not meant to be a limitation of the present invention. FIG. 12 is a diagram illustrating an alternative design of an overdrive processing circuit according to the present invention. The overdrive processing circuit 812 included in one of the above-mentioned overdrive apparatuses 800-1100 may be replaced with the overdrive processing circuit 1200 shown in FIG. 12. The overdrive processing circuit 1200 includes a processing circuit 1202 and a blending circuit 1204. Regarding a pixel in a non-blending display region/vertical blending region that is co-located in a current frame and a previous frame, it has a pixel value $G_n$ in the current frame and a pixel value $G_{n-1}$ in the previous frame. An overdrive calculation value $G_n'$ is therefore derived from one overdrive look-up table and transmitted to the processing unit 1202, and then the processing unit 1202 converts the overdrive calculation value $G_n'$ into the target overdrive value $G_n''$. Regarding a pixel in a horizontal blending display region that is co-located in a current frame and a previous frame, it has a pixel value $G_n$ in the current frame and a pixel value $G_{n-1}$ in the previous frame. Two overdrive calculation values $G_{n_}\mathbf{1}'$ and $G_{n_}\mathbf{2}'$ are respectively derived from overdrive look-up tables of two horizontally adjacent non-blending display regions/vertical blending regions and transmitted to the processing unit 1202. Next, the processing unit 1202 is operative to convert the overdrive calculation values $G_{n_}\mathbf{1}'$ and $G_{n_}\mathbf{2}'$ into converted overdrive output values $G_{n_}\mathbf{1}'$ and $G_{n_}\mathbf{2}''$, respectively. After receiving the converted overdrive output values $G_{n_}\mathbf{1}''$ and $G_{n_}\mathbf{2}''$, the blending unit 1204 generates the target overdrive output value $G_n''$ by blending the converted overdrive output values $G_{n_}\mathbf{1}''$ and $G_{n_}\mathbf{2}''$. For example, the blending unit 1204 may use the following equations to derive a blended overdrive value as its output.

Suppose that the width of each horizontal blending region corresponds to P pixels at the same row, and the width of each horizontal blending region is evenly divided into N segments each have P/N pixels at the same row, where a $1^{st}$ segment is immediately adjacent to a left non-blending display region/vertical blending region, and an $N^{th}$ segment is immediately adjacent to a right non-blending display region/vertical blending region. It should be noted that P and N are positive integers, and N may be equal to or smaller than P. When a specific pixel to be processed is located in an $I^{th}$ segment of a horizontal blending region, a converted overdrive calculation value corresponding to an overdrive calculation value derived from the left non-blending display region/vertical blending region for a pixel value of the specific pixel includes R0'/G0'/B0', and a converted overdrive calculation value corresponding to an overdrive calculation value derived from the right non-blending display region/vertical blending region for the pixel value of the specific pixel includes R1'/G1'/B1', the target overdrive calculation value (i.e., a blended overdrive value) $R_B''/G_B''/B_B''$ for the pixel value of the specific pixel may be expressly as follows.

$$R_B'' = R0' * \left(1 - \frac{I}{N}\right) + R1' * \frac{I}{N} \tag{4}$$

$$G_B'' = G0' * \left(1 - \frac{I}{N}\right) + G1' * \frac{I}{N} \tag{5}$$

$$B_B'' = B0' * \left(1 - \frac{I}{N}\right) + B1' * \frac{I}{N} \tag{6}$$

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. An overdrive apparatus, comprising:

a data storage device, arranged for storing M overdrive look-up tables respectively corresponding to M first display regions included in a display area of a display apparatus, wherein M>1;

N table storage devices, arranged for storing N selected overdrive look-up tables, respectively, wherein 2≤N<M, and one of the N table storage devices is used for driving pixels of a corresponding first display region; and a table access interface, coupled between the data storage device and the N table storage devices and arranged for loading the N selected overdrive look-up tables selected from the M overdrive look-up tables stored in the data storage device into the N table storage devices, wherein the table access interface loads one of the N selected overdrive look-up tables into one of the N table storage devices while another one of the N selected overdrive look-up tables stored in another one of the N table storage devices is being used for driving pixels of a corresponding first display region.

2. The overdrive apparatus of claim 1, further comprising:

a data buffering device, coupled between the table access interface and the data storage device and arranged for buffering the selected overdrive look-up tables prefetched from the data storage device, wherein a data access speed of the data buffering device is higher than a data access speed of the data storage device, and the table access interface reads the data buffering device to load the selected overdrive look-up tables buffered in the data buffering device into the table storage devices.

3. The overdrive apparatus of claim 1, wherein the display area of the display apparatus further includes a plurality of second display regions; and a plurality of first overdrive look-up tables of the selected overdrive look-up tables that are stored in a plurality of first table storage devices of the table storage devices are arranged to be accessed for driving pixels of a second display region.

4. The overdrive apparatus of claim 3, wherein the table access interface loads a second overdrive look-up table into a second table storage device of the table storage devices while at least one of the first overdrive look-up tables stored in the first table storage devices is being used for driving pixels.

5. The overdrive apparatus of claim 4, wherein the first display regions to which the first overdrive look-up tables respectively correspond are horizontally adjacent to each other.

6. The overdrive apparatus of claim 3, wherein the second display region is located between first display regions to which the first overdrive look-up tables respectively correspond.

7. The overdrive apparatus of claim 1, further comprising:

an overdrive processing circuit, arranged for generating a target overdrive output value according to overdrive calculation values derived from one of the N selected overdrive look-up tables.

8. The overdrive apparatus of claim 7, wherein the overdrive processing circuit comprises:

a blending unit, arranged for generating a blended overdrive calculation value by blending the overdrive calculation values; and a processing unit, arranged for converting the blended overdrive calculation value into the target overdrive output value.

9. The overdrive apparatus of claim 7, wherein the overdrive processing circuit comprises:

a processing circuit, arranged for converting the overdrive calculation values into a plurality of converted overdrive output values, respectively; and a blending unit, arranged for generating the target overdrive output value by blending the converted overdrive output values.

10. The overdrive apparatus of claim 1, further comprising:

a temperature sensor, arranged for detecting a work temperature;

wherein regarding at least one of the first display regions, a selected overdrive look-up table loaded by the table access interface under a first work temperature detected by the temperature sensor is different from the selected overdrive look-up table loaded by the table access interface under a second work temperature detected by the temperature sensor.

11. The overdrive apparatus of claim 1, wherein the number of the N table storage devices is equal to two.

12. An overdrive apparatus, comprising:

a data storage device, arranged for storing M overdrive look-up tables respectively corresponding to M first display regions included in a display area of a display apparatus, wherein the display area of the display apparatus further includes a plurality of second display regions and M>1;

N table storage devices, arranged for storing N selected overdrive look-up tables, respectively, wherein $2 \leq N < M$ and one of the N table storage devices is used for driving pixels of a corresponding first display region and the N table storage devices includes a plurality of first table storage devices and a second table storage device; and a table access interface, coupled between the data storage device and the N table storage devices and arranged for loading the N selected overdrive look-up tables selected from the M overdrive look-up tables stored in the data storage device into the N table storage devices, wherein the table access interface loads a second overdrive look-up table of the N selected overdrive look-up tables into the second table storage device of the N table storage devices while at least one of a plurality of first overdrive look-up tables stored in the plurality of first table storage devices is being used for driving pixels;

wherein the plurality of first overdrive look-up tables stored in the plurality of first table storage devices of the N table storage devices are arranged to be accessed for driving pixels of a second display region.

13. The overdrive apparatus of claim 12, wherein the second display region is located between first display regions to which the first overdrive look-up tables respectively correspond.

14. The overdrive apparatus of claim 13, wherein the first display regions to which the first overdrive look-up tables respectively correspond are horizontally adjacent to each other.

15. The overdrive apparatus of claim 12, further comprising:

an overdrive processing circuit, arranged for generating a target overdrive output value according to overdrive calculation values derived from one of the N selected overdrive look-up tables.

16. The overdrive apparatus of claim 15, wherein the overdrive processing circuit comprises:

a blending unit, arranged for generating a blended overdrive calculation value by blending the overdrive calculation values; and a processing unit, arranged for converting the blended overdrive calculation value into the target overdrive output value.

17. The overdrive apparatus of claim 15, wherein the overdrive processing circuit comprises:

a processing circuit, arranged for converting the overdrive calculation values into a plurality of converted overdrive output values, respectively; and a blending unit, arranged for generating the target overdrive output value by blending the converted overdrive output values.

18. The overdrive apparatus of claim 12, further comprising:

a temperature sensor, arranged for detecting a work temperature;

wherein regarding at least one of the first display regions, a selected overdrive look-up table loaded by the table access interface under a first work temperature detected by the temperature sensor is different from the selected overdrive look-up table loaded by the table access interface under a second work temperature detected by the temperature sensor.

19. An overdrive method, comprising:

storing M overdrive look-up tables respectively corresponding to M first display regions included in a display area of a display apparatus, wherein M>1; and loading N selected overdrive look-up tables selected from the M overdrive look-up tables into N table storage devices, respectively, wherein $2 \leq N < M$;

storing the N selected overdrive look-up tables, respectively, wherein one of the N table storage devices is being used for driving pixels of a corresponding first display region while another one of the N selected overdrive look-up tables is being loaded into another one of the N table storage devices.

20. An overdrive method, comprising:

storing M overdrive look-up tables respectively corresponding to M first display regions included in a display area of a display apparatus, wherein the display area of the display apparatus further includes a plurality of second display regions, wherein M>1;

loading N selected overdrive look-up tables selected from the M overdrive look-up tables into N table storage devices, wherein $2 \leq N < M$ and the N table storage devices includes a plurality of first table storage devices and a second table storage device;

storing the N selected overdrive look-up tables, respectively, wherein a second overdrive look-up table of the N selected overdrive look-up tables is being loaded into the second table storage device of the N table storage devices while at least one of a plurality of first overdrive look-up tables stored in the plurality of first table storage devices is being used for driving pixels; and reading the plurality of first overdrive look-up tables stored in the plurality of first table storage devices of the N table storage devices for driving pixels of a second display region.

* * * * *

UNITED STATES PATENT AND TRADEMARK OFFICE

CERTIFICATE OF CORRECTION

PATENT NO. : 9,053,674 B2
APPLICATION NO. : 13/342192
DATED : June 9, 2015
INVENTOR(S) : Chiuan-Shian Chen et al.

It is certified that error appears in the above-identified patent and that said Letters Patent is hereby corrected as shown below:

On the title page, item (54), and in the specification, column 1, lines 1-5, correct the title of invention from "OVERDRIVE APPARATUS FOR DYNAMICALLY LOADING REQUIRED OVERDRIVE LOOK-UP TABLES INTO TABLE STORAGE DEVICES AND RELATED OVERDRIVE METHOD" to --OVERDRIVE APPARATUS FOR DYNAMICALLY LOADING REQUIRED OVERDRIVE LOOK-UP TABLES INTO TABLE STORAGE DEVICES AND RELATED OVERDRIVE METHOD THEREOF--

Signed and Sealed this
First Day of December, 2015

Michelle K. Lee

Michelle K. Lee
*Director of the United States Patent and Trademark Office*